US008934795B2

(12) United States Patent
Hashiguchi et al.

(10) Patent No.: US 8,934,795 B2
(45) Date of Patent: Jan. 13, 2015

(54) OPTICAL SENSOR UNIT WITH SHUTTER MEMBER AND IMAGE-FORMING APPARATUS THEREOF

(75) Inventors: Masafumi Hashiguchi, Yokohama (JP); Toshio Yanata, Ebina (JP); Masahiko Sato, Sagamihara (JP); Masataka Akaishi, Ebina (JP); Sohichiroh Naka, Zama (JP)

(73) Assignee: Ricoh Company, Ltd., Tokyo (JP)

( * ) Notice: Subject to any disclaimer, the term of this patent is extended or adjusted under 35 U.S.C. 154(b) by 235 days.

(21) Appl. No.: 13/533,640

(22) Filed: Jun. 26, 2012

(65) Prior Publication Data

US 2013/0004189 A1 Jan. 3, 2013

(30) Foreign Application Priority Data

Jun. 30, 2011 (JP) ..... 2011-145873

(51) Int. Cl.
*G03G 21/00* (2006.01)
*G03G 15/00* (2006.01)
*G03G 15/01* (2006.01)

(52) U.S. Cl.
CPC ..... *G03G 15/5058* (2013.01); *G03G 15/0131* (2013.01); *G03G 2215/0132* (2013.01)
USPC ..... 399/49

(58) Field of Classification Search
USPC ..... 399/49, 55, 74
See application file for complete search history.

(56) References Cited

U.S. PATENT DOCUMENTS

| | | | | |
|---|---|---|---|---|
| 6,331,918 | B1 * | 12/2001 | Shirai | 359/698 |
| 2008/0145089 | A1 * | 6/2008 | Takahashi | 399/74 |
| 2011/0052239 | A1 | 3/2011 | Tanaka et al. | |

FOREIGN PATENT DOCUMENTS

| | | | |
|---|---|---|---|
| JP | 06-186805 | A | 7/1994 |
| JP | 2001-108618 | A | 4/2001 |
| JP | 2002-131997 | A | 5/2002 |
| JP | 2004-184698 | A | 7/2004 |
| JP | 2006-208645 | A | 8/2006 |
| JP | 2011-048185 | A | 3/2011 |
| JP | 2011-059369 | A | 3/2011 |

* cited by examiner

*Primary Examiner* — Quana M Grainger
(74) *Attorney, Agent, or Firm* — Harness, Dickey & Pierce, P.L.C.

(57) ABSTRACT

An optical sensor unit includes: a light-emitting device; a light-receiving device that receives light which is emitted from the light-emitting device and reflected from an object to be detected, and outputs an output value in accordance with the light; a shutter member that openably and closably covers an incident/exit plane having an exit part where light of the light-emitting device is emitted to the object to be detected and an incident part where light reflected from the object to be detected enters, and has a facing surface facing the incident/exit plane that is an inclined surface inclined to the incident/exit plane; and a corrector that corrects an output value of the light-receiving device when receiving light reflected from the object to be detected, based on an output value of the light-receiving device obtained by emitting light to the inclined surface of the shutter member.

8 Claims, 14 Drawing Sheets

OPTICAL SENSOR UNIT WITH SHUTTER MEMBER AND IMAGE-FORMING APPARATUS THEREOF

CROSS-REFERENCE TO RELATED APPLICATIONS

The present application is based on and claims priority from Japanese patent application number 2011-145873, filed Jun. 30, 2011, the disclosure of which is hereby incorporated by reference herein in its entirety.

BACKGROUND

The present invention relates to an optical sensor unit and an image-forming apparatus.

Conventionally, image-forming apparatuses that perform image quality adjustment control such as process control, based on predetermined conditions such that immediately after the power is turned on, accumulation of printouts reaches a predetermined number, and so on are known. For example, the image quality adjustment control is performed as follows. Firstly, light emitted from a light-emitting element of an optical sensor unit as a light-emitting device is reflected by a surface skin part (a part where toner does not adhere.) of an intermediate transfer belt as an object to be detected, and the reflected light is received by a light-receiving element of the optical sensor unit as a light-receiving device, and an output signal (voltage) according to the reflected light is outputted. Next, a reference toner image that has a predetermined shape is formed on a surface of a photoreceptor, the reference toner image is transferred on the intermediate transfer belt, light emitted from the light-emitting element is reflected on the reference toner image as an object to be detected, the reflected light is received by the light-receiving element, and an output signal according to the reflected light is outputted. And then, the output signal on the surface skin part of the intermediate transfer belt is taken as a reference value, the reference value and the output signal in the reference toner image are compared, and a toner adhesion amount per unit area of the reference toner image is obtained. Based on the toner adhesion amount obtained in this way, image-forming conditions such as a uniform charge potential of the receptor, developing bias, optical writing intensity to the receptor, a control target value of toner density of a developer, and so on are adjusted such that the toner adhesion amount is a desired amount.

By such image quality adjustment control, it is possible to perform printout with stable image density for long periods.

There is a case where light other than the reflected light of the object to be detected such as the intermediate transfer belt, the reference toner image on the intermediate transfer belt, or the like enters the light-receiving element of the optical sensor unit. An output signal from the light-receiving element due to the light other than the reflected light of the object to be detected is called crosstalk (a crosstalk voltage, in a case where the output signal is voltage), and it is preferable to keep it as low as possible, because of degrading detection accuracy of the object to be detected.

Japanese Patent Application Publication number 2011-048185 discloses an optical sensor unit such that an output value of a light-receiving device when receiving light reflected from an object to be detected is corrected so that the output value in which a component of crosstalk is removed is obtained. Specifically, a shutter member that covers an incident/exit plane where an exit part where light of the optical sensor unit is emitted and an incident part where reflected light enters is provided, and a light absorption member is provided on a facing surface of the shutter member facing the incident/exit plane. When measuring the crosstalk, in a state of facing the light absorption member provided on the shutter member to the incident/exit plane (in a state where the shutter member is closed), light is emitted to the light absorption member. The light emitted to the light absorption member does not reflect, and the reflected light is not received by the light-receiving device. Therefore, an output voltage of the light-receiving device obtained by emitting the light at this time is an output voltage by the light other than the reflected light of the object to be detected, and is known as so-called crosstalk. Thus, it is possible to measure crosstalk of the optical sensor unit.

SUMMARY

However, in the optical sensor unit disclosed in Japanese Patent Application Publication number 2011-048185, a light absorption member needs to be provided on the shutter member, and the number of components increases, which leads to a problem of an increase in costs of an apparatus.

An object of the present invention is to provide an optical sensor unit and an image-forming apparatus that obtain an output value where noise due to crosstalk is reduced from an output value of an object to be detected, and suppress an increase in costs of an apparatus.

In order to achieve the object, and embodiment of the present invention provides: an optical sensor unit comprising: a light-emitting device; a light-receiving device that receives light which is emitted from the light-emitting device and reflected from an object to be detected, and outputs an output value in accordance with the light; a shutter member that openably and closably covers an incident/exit plane having an exit part where light of the light-emitting device is emitted to the object to be detected and an incident part where light reflected from the object to be detected enters, and has a facing surface facing the incident/exit plane that is an inclined surface inclined to the incident/exit plane; and a corrector that corrects an output value of the light-receiving device when receiving light reflected from the object to be detected, based on an output value of the light-receiving device obtained by emitting light to the inclined surface of the shutter member.

Figure 5A:
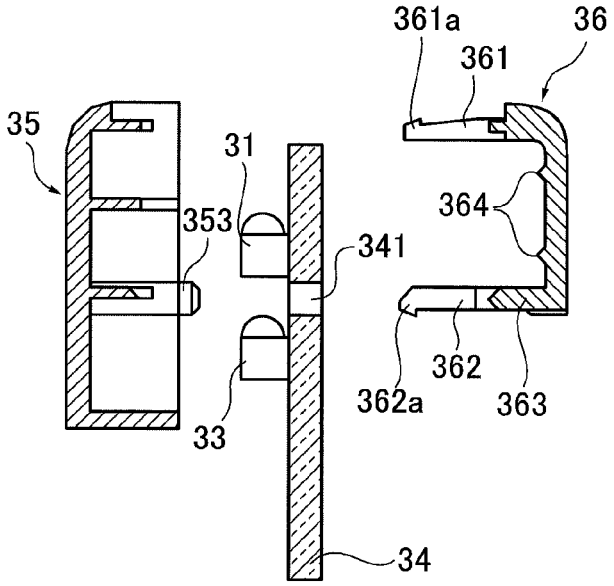
Figure 5B:
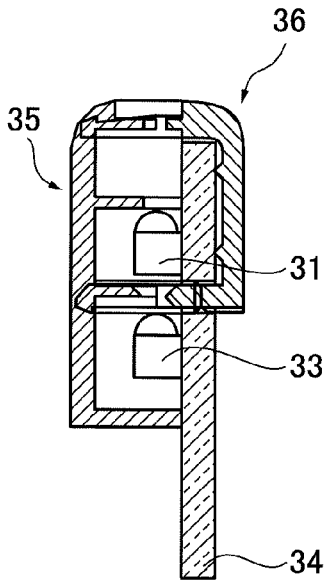

Each of FIGS. 5A and 5B is a cross-sectional diagram explaining a constitution of the sensor part.

Figure 6:
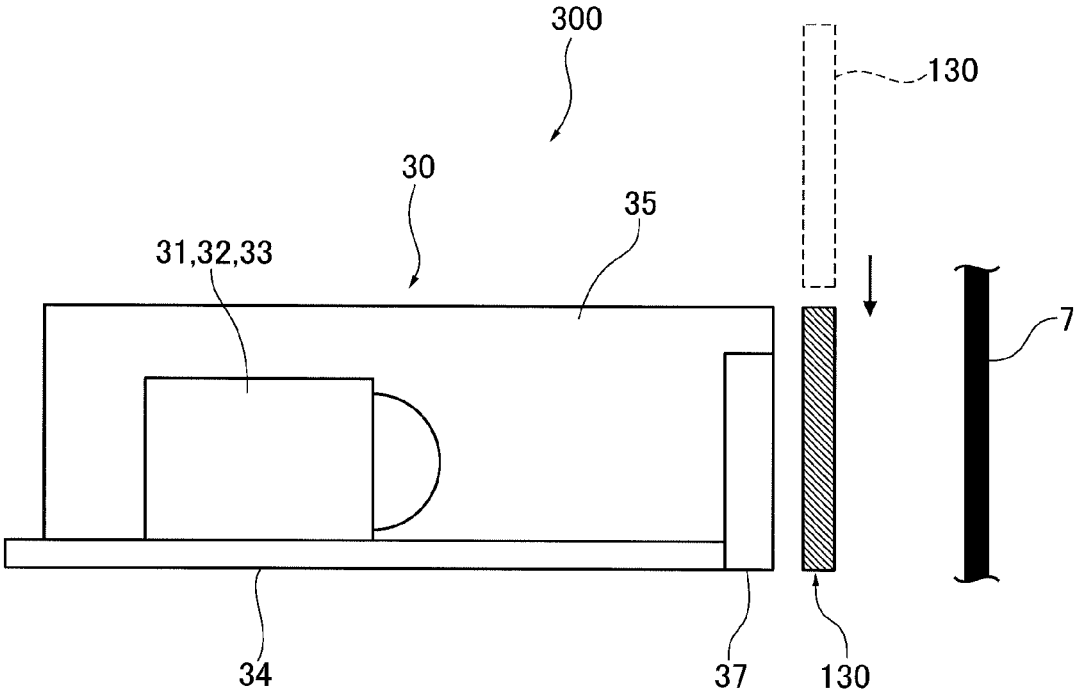

FIG. 6 is a schematic constitution illustrating a part of the sensor part and a shutter member.

Figure 7:
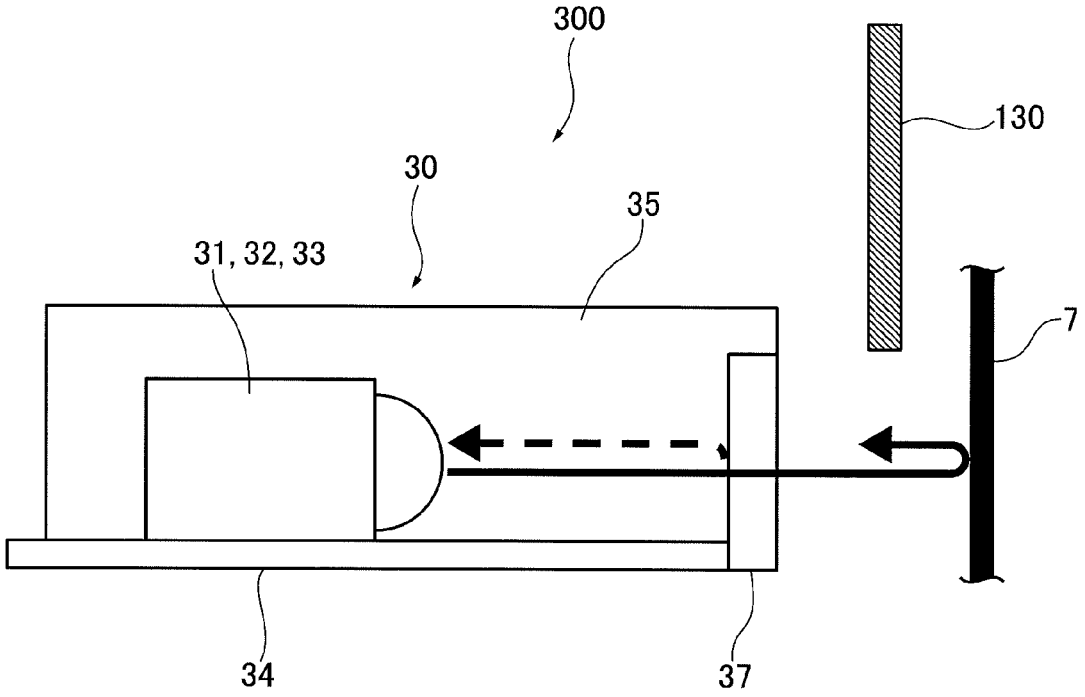

FIG. 7 is a diagram explaining crosstalk of the sensor part.

Figure 8:
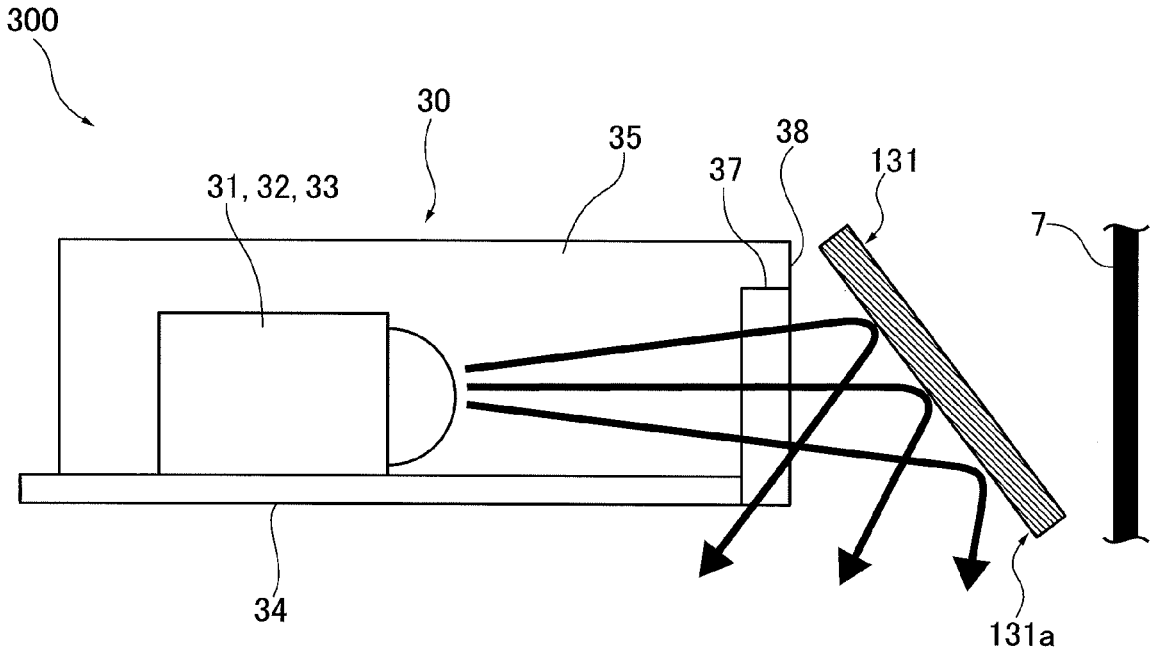

FIG. 8 is a schematic constitution diagram illustrating a constitution that detects a crosstalk voltage.

Figure 9:
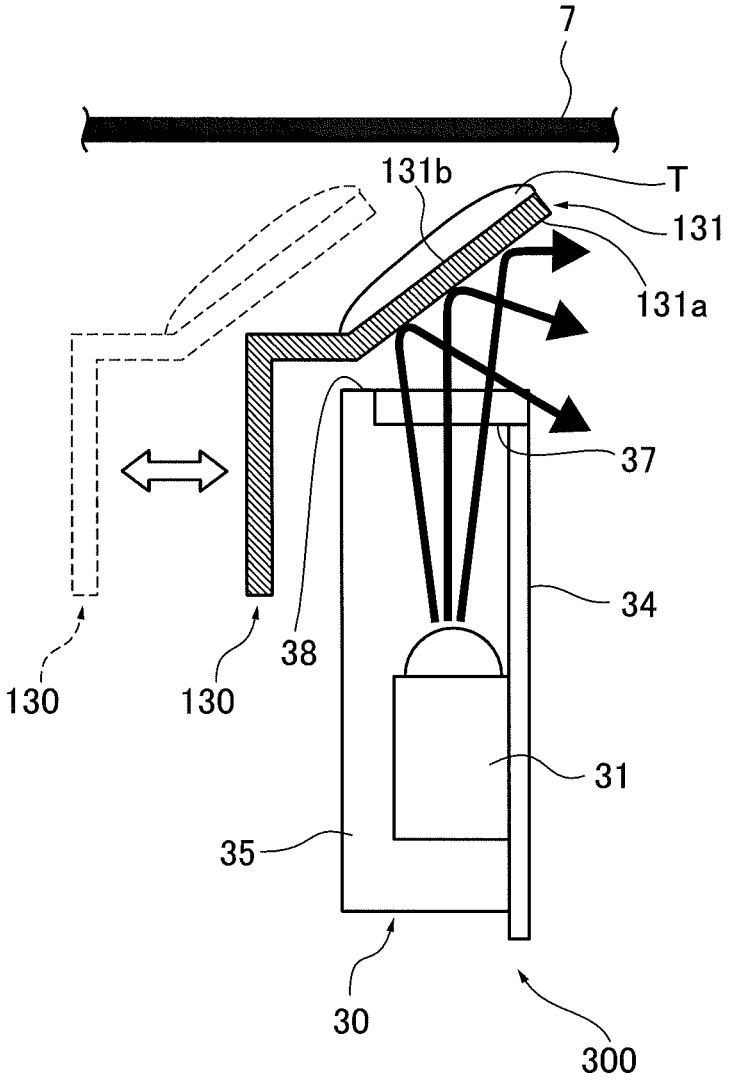

FIG. 9 is a schematic constitution diagram illustrating a first variation example of a constitution that detects a crosstalk voltage.

Figure 10:
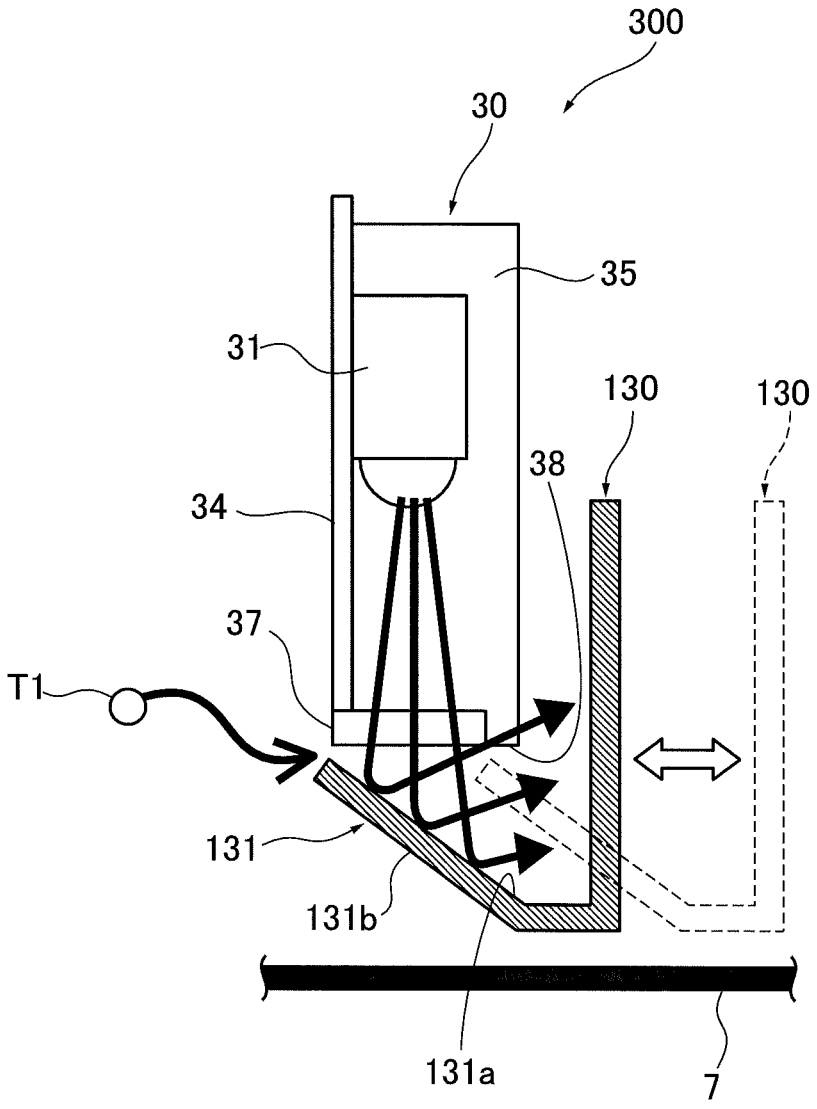

FIG. 10 is a schematic constitution diagram illustrating a second variation example of a constitution that detects a crosstalk voltage.

Figure 11:
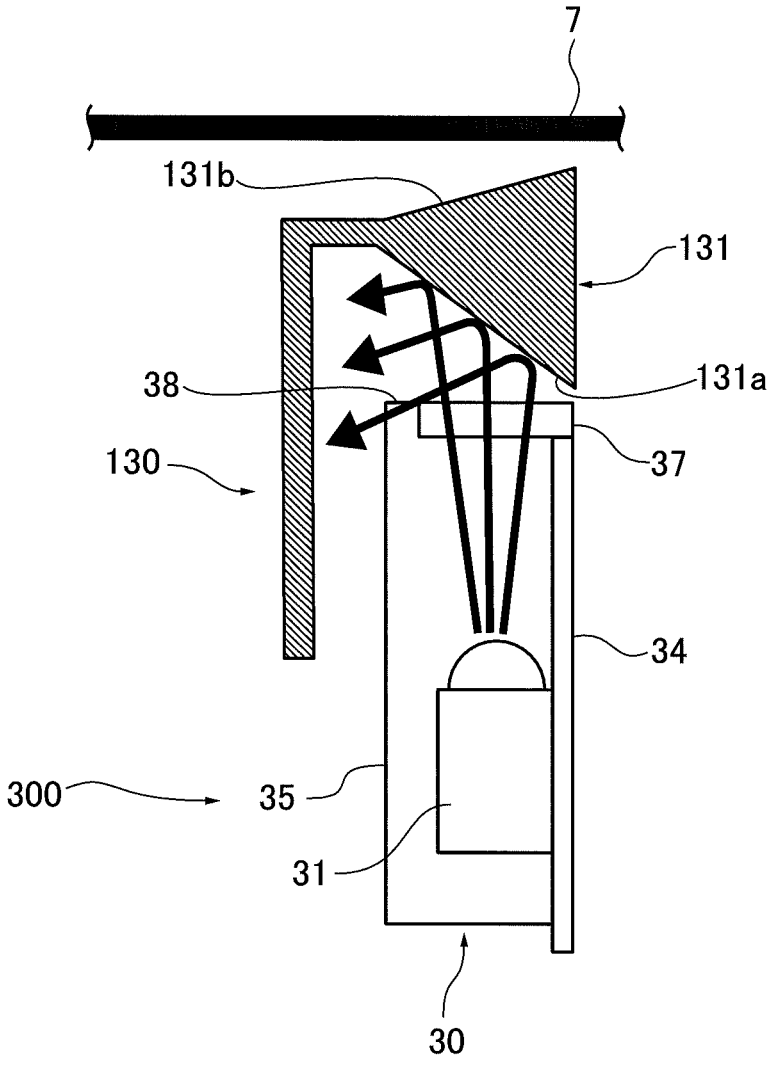

FIG. 11 is a schematic constitution diagram illustrating a third variation example of a constitution that detects a crosstalk voltage.

Figure 12:
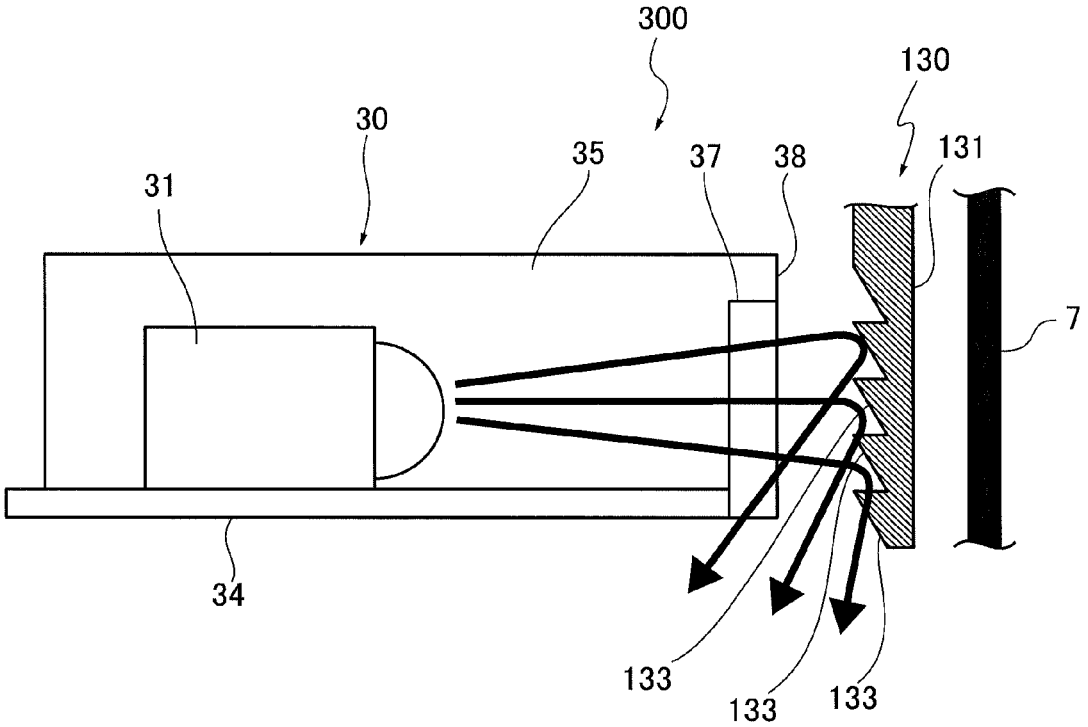

FIG. 12 is a schematic constitution diagram illustrating a fourth variation example of a constitution that detects a crosstalk voltage.

Figure 13:
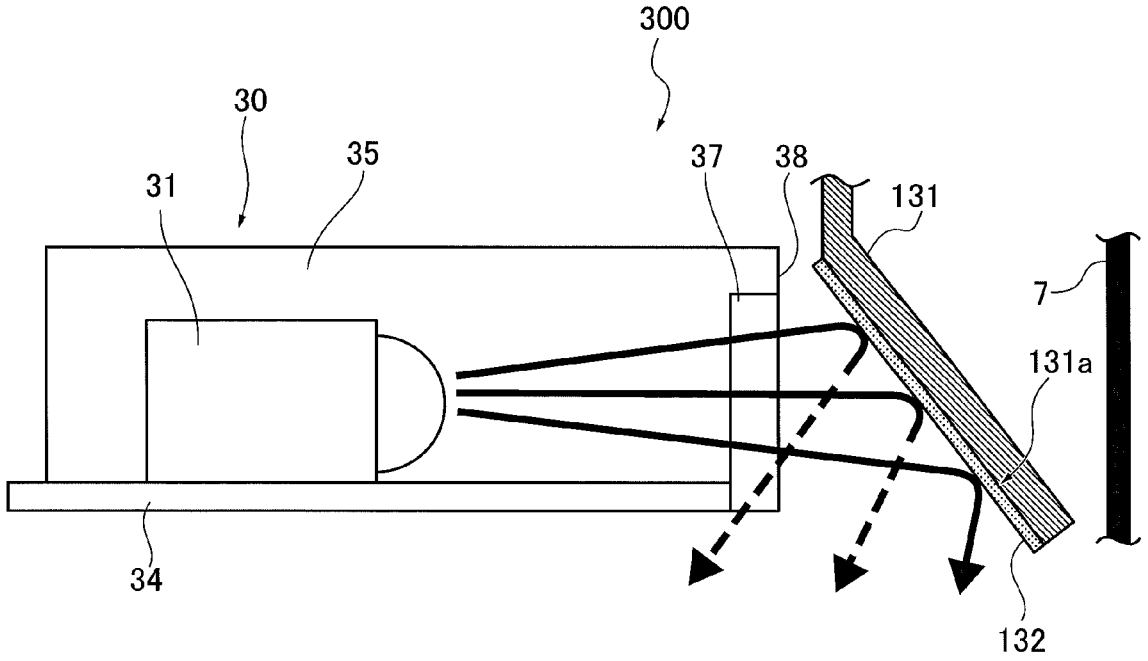

FIG. 13 is a schematic constitution diagram illustrating a fifth variation example of a constitution that detects a crosstalk voltage.

Figure 14:
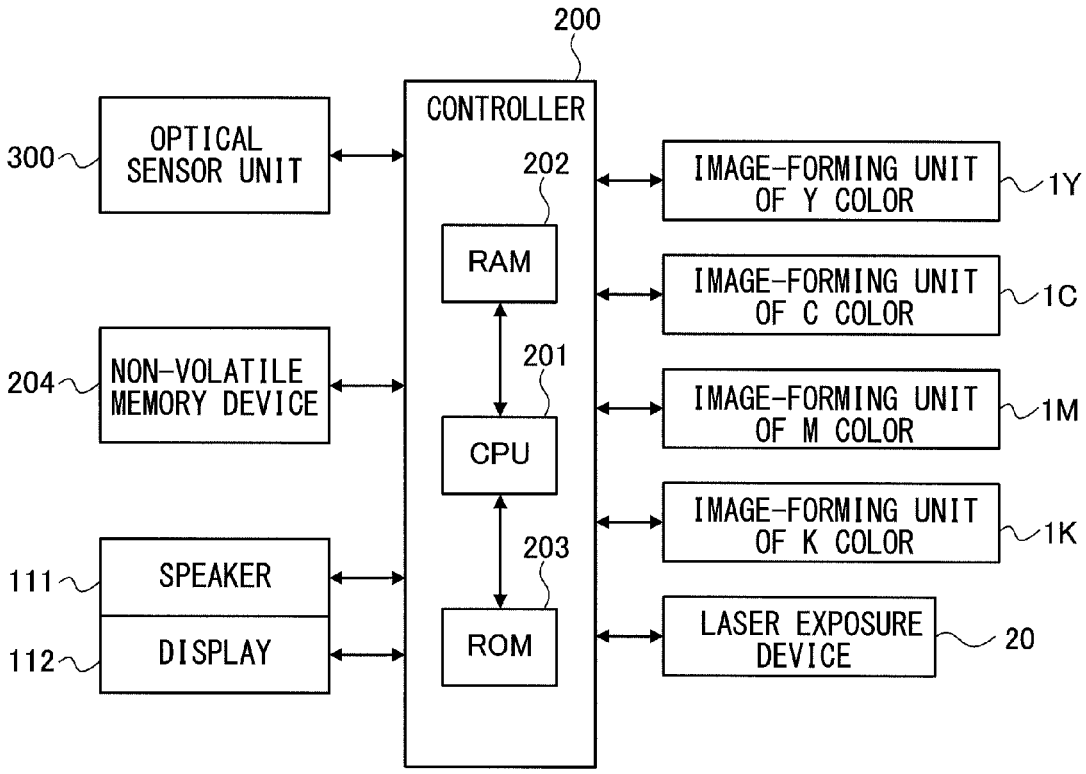

FIG. 14 is a block diagram illustrating a chief part of an electric circuit of the printer.

Figure 15:
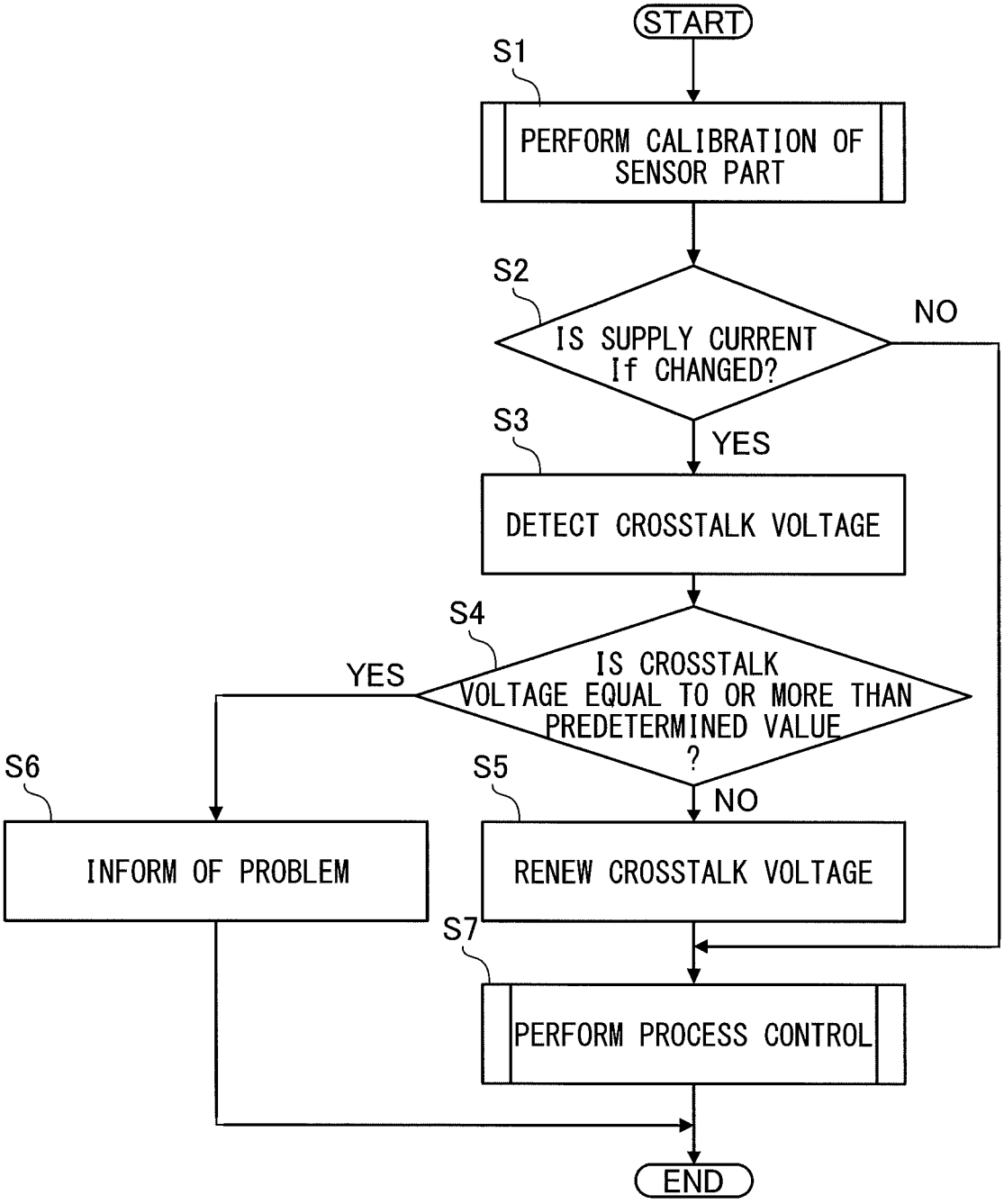

FIG. 15 is a flow diagram of image density control.

Figure 16:
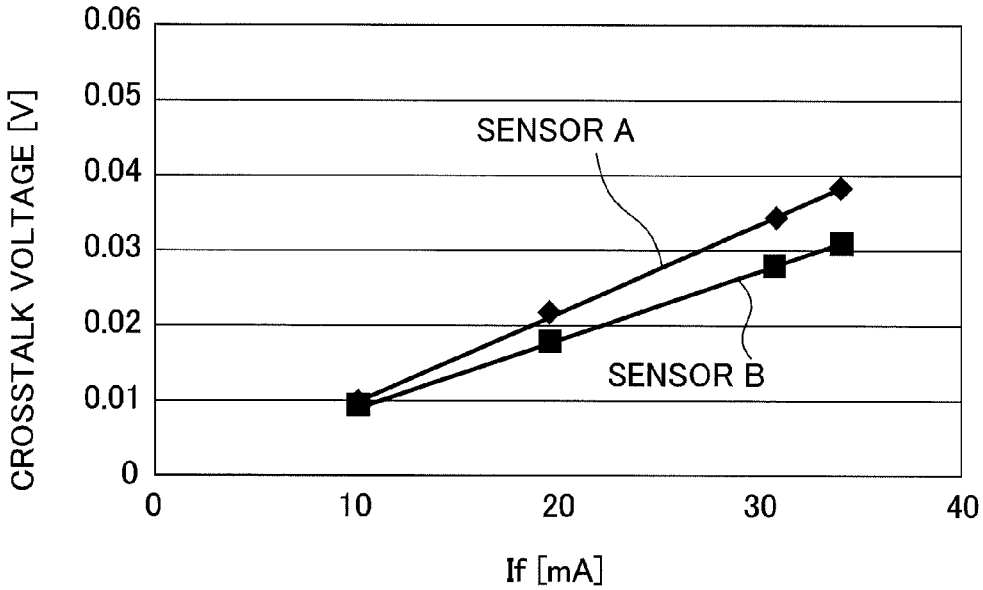

FIG. 16 is a graph illustrating a relationship between a crosstalk voltage and an electric current If that is supplied to a light-emitting element.

Figure 17:
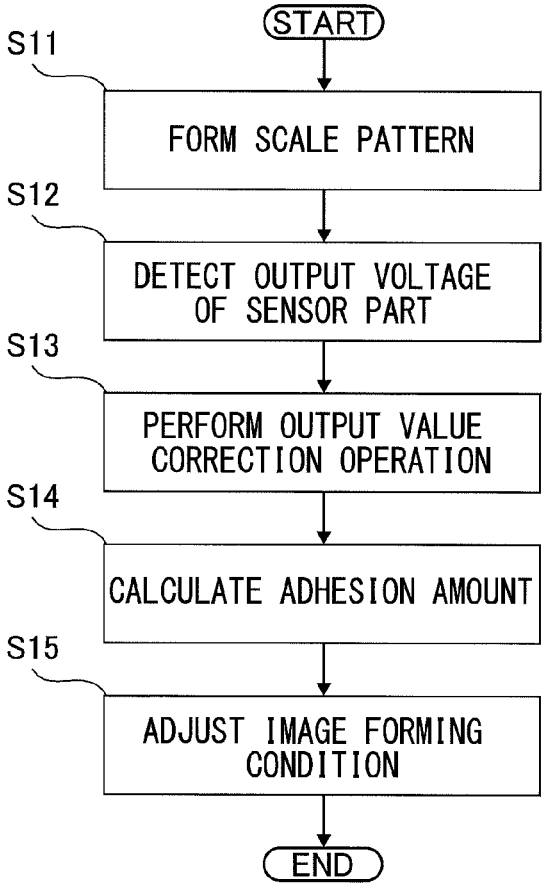

FIG. 17 is a control flow diagram of process control.

Figure 18:
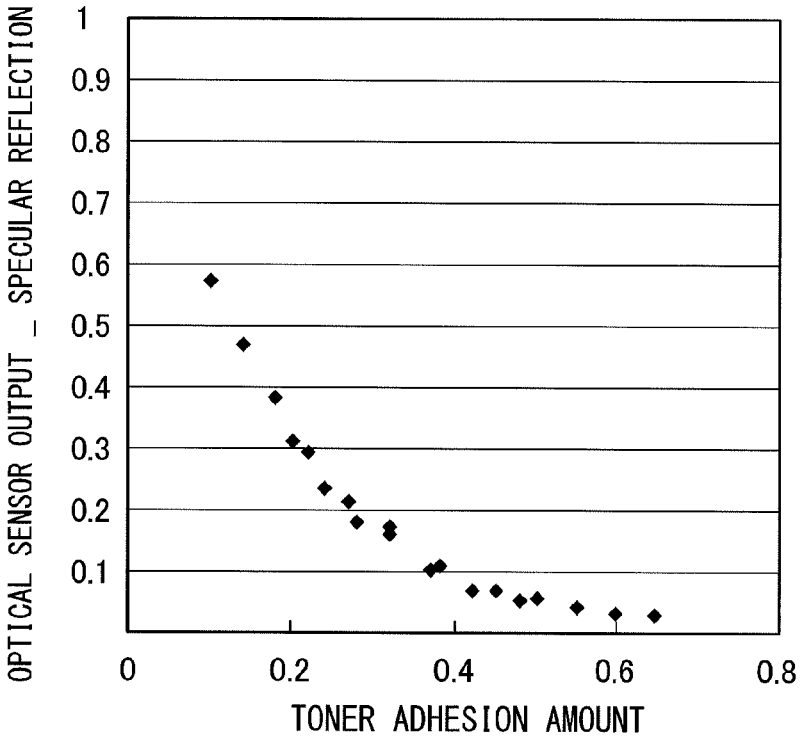

FIG. 18 is a graph illustrating a relationship between an output value of a first light-receiving element of the sensor part and a toner adhesion amount.

Figure 19:
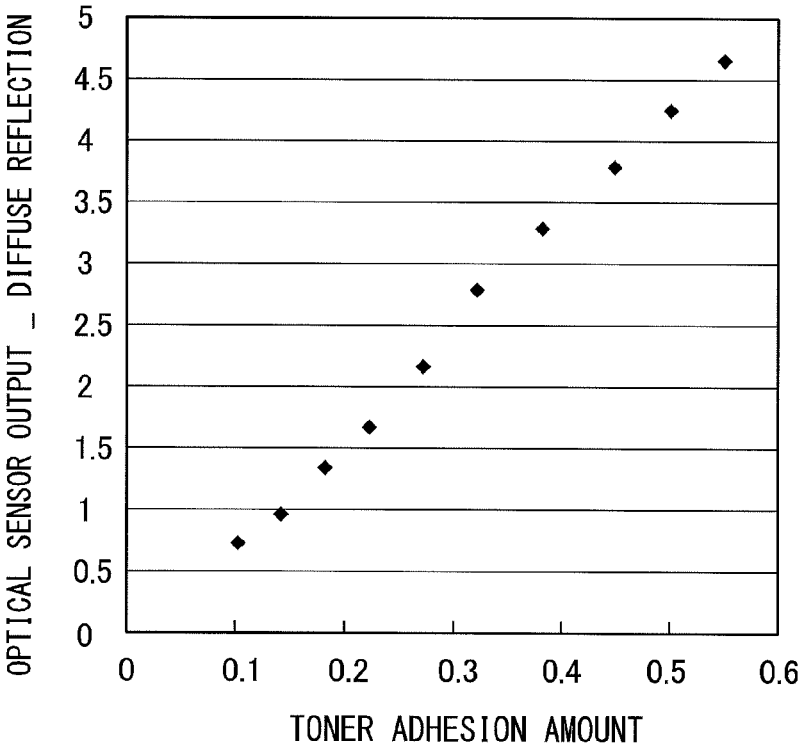

FIG. 19 is a graph illustrating a relationship between an output value of a second light-receiving element of the sensor part and a toner adhesion amount.

Figure 20:
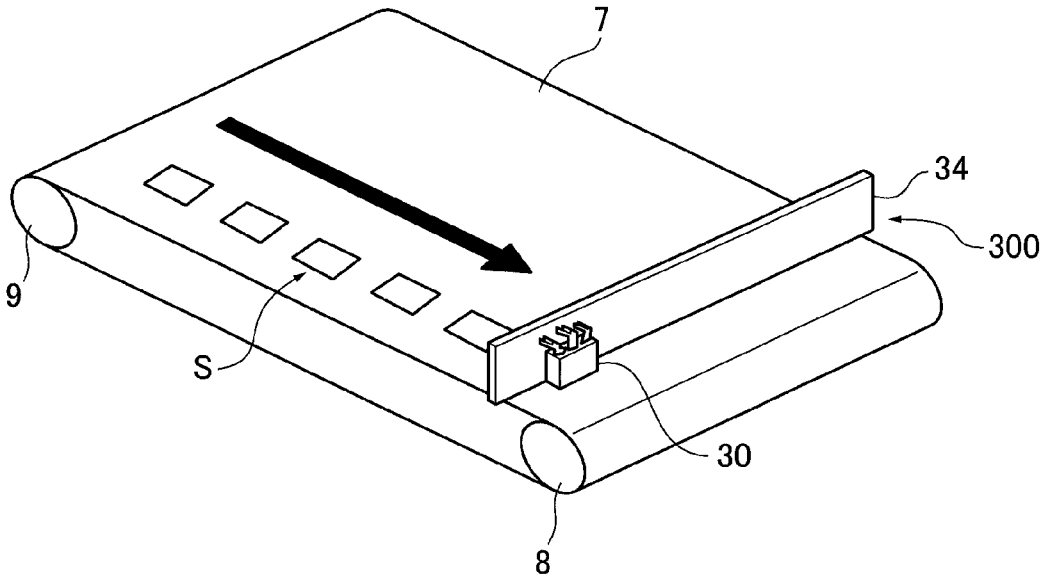

FIG. 20 is a schematic constitution diagram illustrating an optical sensor unit that has one sensor part, and an intermediate transfer belt.

DETAILED DESCRIPTION OF THE PREFERRED EMBODIMENTS

Figure 1:
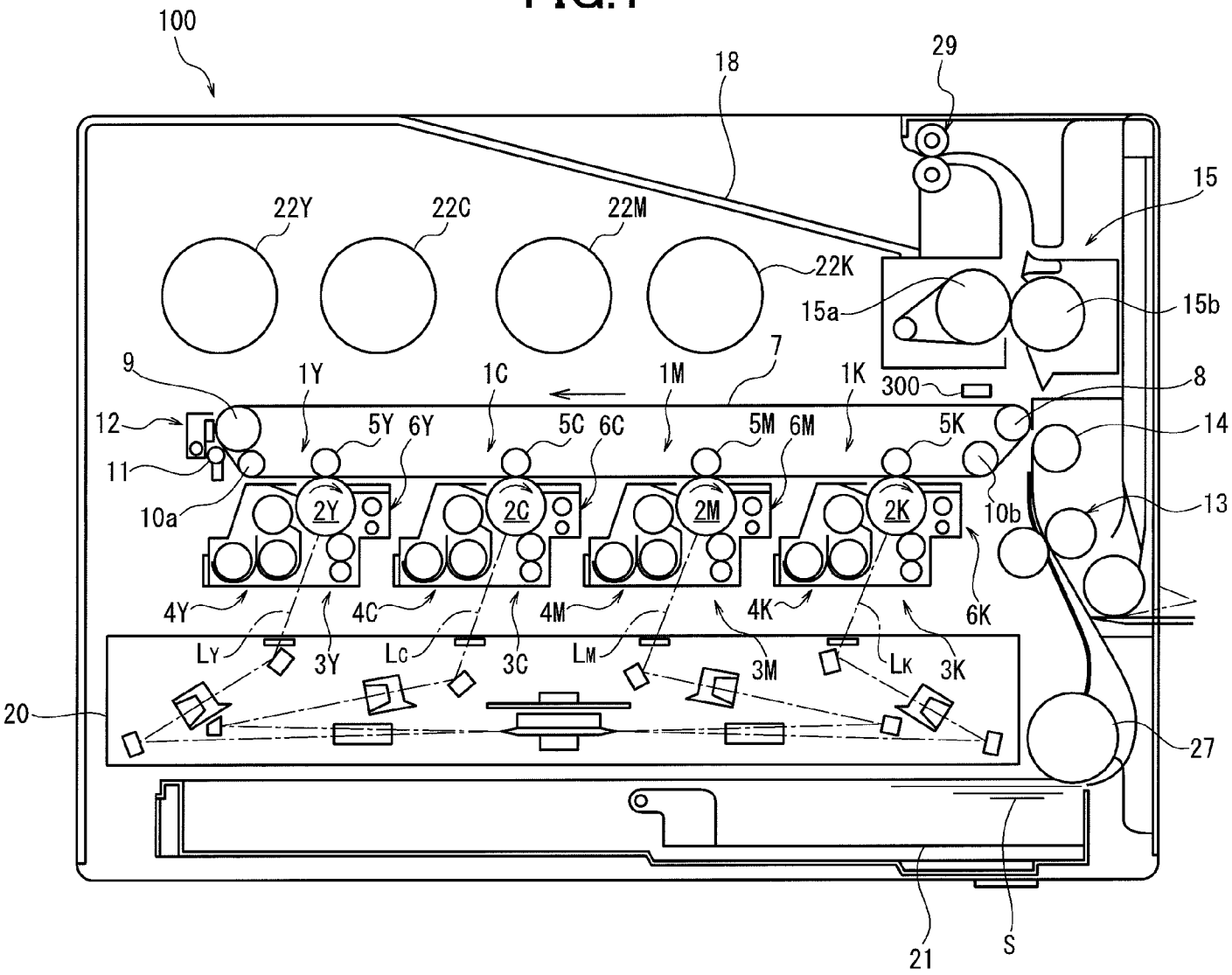
FIG. 1 is a schematic constitution diagram explaining a constitution of a printer according to an embodiment of the present invention.

Hereinafter, an embodiment will be explained in a case where the present invention is applied to a full-color printer (hereinafter, referred to as a printer) 100 as an image-forming apparatus. FIG. 1 is a schematic constitution diagram explaining a constitution of the printer 100. As illustrated in FIG. 1, the printer 100 includes an apparatus body as an image-forming device in which each constitutional member is stored, and that is positionally-fixed, and a paper-feeding cassette 21 that is drawable and stores a transfer member S. In the center of the apparatus body, the printer 100 includes image-forming units 1Y, 1C, 1M, 1K that form a toner image of each of yellow (Y), cyan (C), magenta (M), and black (K) colors. Hereinafter, each suffix of Y, C, M, K of each reference number illustrates a member for each of the yellow, cyan, magenta, and black colors.

Figure 2:
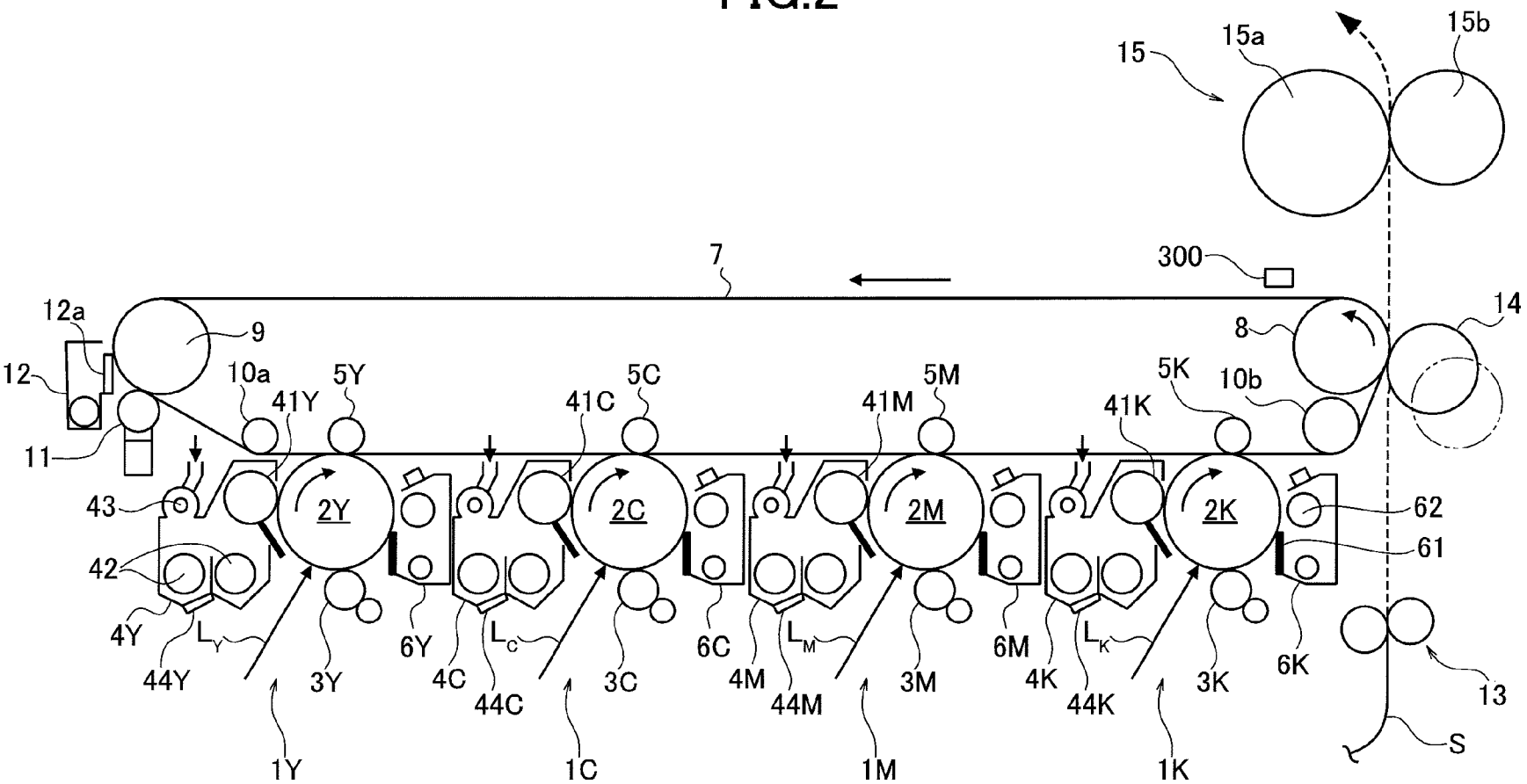
FIG. 2 is a schematic constitution diagram explaining a constitution of an image-forming device of the printer.

FIG. 2 is a schematic constitution diagram explaining a constitution of an image-forming device of the printer. As illustrated in FIGS. 1 and 2, the image-forming device of the printer 100 is constituted such that the image-forming units 1Y, 1C, 1M, 1K of each of the yellow (Y), cyan (C), magenta (M), and black (K) colors are arranged to face a flat stretch surface of an intermediate transfer belt 7 as an image carrier that runs in a loop shape in order of Y, C, M, K from the left. Each of the image-forming units 1Y, 1C, 1M, 1K is constructed as a unit that has the same constitution. The image-forming units 1Y, 1C, 1M, 1K at least include drum-shaped photoreceptors 2Y, 2C, 2M, 2K as image carriers, charge rollers 3Y, 3C, 3M, 3K as charge devices, a laser exposure device 20 as an image-writing device (exposure device), developing devices 4Y, 4C, 4M, 4K, and cleaning devices 6Y, 6C, 6M, 6K that remove excess transfer toners on a surface of the photoreceptor.

The charge rollers 3Y, 3C, 3M, 3K of the image-forming units 1Y, 1C, 1M, 1K perform a charge operation on the photoreceptors 2Y, 2C, 2M, 2K by the same polarity charge as toners that are kept at a predetermined potential, respectively (a negative charge in the present embodiment), and uniform potential is applied to the photoreceptors 2Y, 2C, 2M, 2K. The charge devices are not limited to the charge rollers, and it is possible to use various types such as a charge brush, a charger, and so on, appropriately.

The laser exposure device 20 performs exposure on upstream sides of the developing devices 4Y, 4C, 4M, 4K and on downstream sides in a rotation direction of the photoreceptors 2Y, 2C, 2M, 2K with respect to the charge rollers 3Y, 3C, 3M and 3K. And additionally, the laser exposure device 20 is arranged to perform exposure scanning in a main scanning direction parallel to each rotation axis of the photoreceptors 2Y, 2C, 2M, 2K.

The laser exposure device 20, for example, includes a light source having a semiconductor laser (LD), a coupling optical system (or a beam-shaping optical system) having a collimating lens, a cylindrical lens, or the like, an optical deflector having a rotating polygon mirror, or the like, an imaging optical system that focuses a laser beam deflected by the optical deflector on a photoreceptor, and so on. The laser exposure device 20 performs image exposure on a photosensitive layer of the photoreceptors 2Y, 2C, 2M, 2K of each color by intensity-modulated laser beams $L_Y$, $L_C$, $L_M$, and $L_K$ in accordance with image data of each color read by an image reader, which is provided by a different constitution and not illustrated, and recorded in a memory (or image data of each color inputted from an external device such as a personal computer, or the like), and forms an electrostatic latent image per color. As the image-writing device (exposure device), other than the above laser exposure device 20, an LED writing device in which a light-emitting diode array (LED array), a lens array, and so on are combined can be used.

Each of the photoreceptors 2Y, 2C, 2M, 2K has photosensitive layers, and on an undercoating layer formed on a surface of its electrically-conductive cylindrical support medium, a potential-generating layer (lower layer), and a potential transfer layer (upper layer) are formed in order, or those photosensitive layers are formed in reverse order. Additionally, on the potential transfer layer or the potential-generating layer, a known surface protection layer, for example, an overcoat layer mainly including a thermoplastic or thermosetting polymer may be formed. In the present embodiment, the electrically-conductive cylindrical support medium of each of the photoreceptors 2Y, 2C, 2M, 2K is grounded.

Each of the developing devices 4Y, 4C, 4M, 4K maintains a predetermined gap with respect to a circumferential surface of each of the photoreceptors 2Y, 2C, 2M, 2K, and has each of developing sleeves 41Y, 41C, 41M, 41K formed by a non-magnetic stainless or aluminum material in a cylindrical shape that rotates in the same direction as a rotating direction of the photoreceptors 2Y, 2C, 2M, 2K. In each of the developing devices 4Y, 4C, 4M, 4K, a one-component, or two-component developer of each of the yellow (Y), cyan (C), magenta (M), and black (C) colors in accordance with each developing color is stored. In the present embodiment, as an example, in each of the developing devices 4Y, 4C, 4M, 4K, the two-component developer (in the present embodiment, a toner is negative-charged.) including a toner and a magnetic carrier is stored. In this case, in the each of the developing sleeves 41Y, 41C, 41M, 41K, a magnet roll to which a plurality of fixed magnets or a plurality of magnetic poles is applied is arranged. Additionally, in each of the developing devices 4Y, 4C, 4M, 4K, an agitating/conveying part 42 by which a developer in a container is agitated and conveyed, and a supplying part 43 to which a toner is supplied from toner bottles 22Y, 22C, 22M, 22K of each color are provided, respectively. Moreover, in each of the developing devices 4Y, 4C, 4M, 4K, each of toner density sensors 44Y, 44C, 44M, 44K that detects toner density of the developer in the container is provided as required.

Each of the developing sleeves 41Y, 41C, 41M, 41K of each of the developing devices 4Y, 4C, 4M, 4K has a predetermined gap, for example, a gap of 100 μm to 500 μm, with respect to a drum surface of each of the photoreceptors 2Y, 2C, 2M, 2K, and maintains a noncontact state by a not-illustrated roller, or the like. By applying a developing bias in which a direct current and an alternating current are superposed to each of the developing sleeves 41Y, 41C, 41M, 41K, contact or noncontact reversal development is performed, and a toner image is formed on each of the photoreceptors 2Y, 2C, 2M, 2K.

Each of cleaning devices 6Y, 6C, 6M, 6K has a cleaning blade 61, and a cleaning roller (or a cleaning brush) 62. The cleaning blade 61 is provided to come into contact with the surface of the photoreceptor from a downstream side to an upstream side in the rotating direction of the photoreceptor.

The intermediate transfer belt 7 as an intermediate transfer medium and an image carrier is provided to contact with and be wound around a drive roller 8 that doubles as a secondary transfer backup roller, a support roller 9, tension rollers 10*a*, 10*b* and a backup roller 11. A rotating direction of the intermediate transfer belt 7 is a counterclockwise direction as illustrated by an arrow in the drawings. The secondary transfer roller 14 is provided to face the drive roller 8 via the intermediate transfer belt 7. And a cleaning blade 12*a* of a cleaning device 12 is provided to come into contact with the intermediate transfer belt 7 at a position of the support roller 9 from a downstream side to an upstream side of the rotating direction of the intermediate transfer belt 7. Additionally, primary transfer rollers 5Y, 5C, 5M, 5K are provided to face the photoreceptors 2Y, 2C, 2M, 2K across the intermediate transfer belt 7, respectively. The intermediate transfer belt 7 is driven by rotation of the drive roller 8 by a not-illustrated drive motor.

The primary transfer rollers 5Y, 5C, 5M, 5K are provided to face the photoreceptors 2Y, 2C, 2M, 2K across the intermediate transfer belt 7, respectively, and form transfer areas between the intermediate transfer belt 7 and the photoreceptors 2Y, 2C, 2M, 2K, respectively. To the primary transfer rollers 5Y, 5C, 5M, 5K, a DC-voltage of an opposite polarity to a toner (in this embodiment, a positive polarity) is applied by a not-illustrated DC power supply, and a toner image of each color formed on each of the photoreceptors 2Y, 2C, 2M, 2K is transferred on the intermediate transfer belt 7.

The secondary transfer roller 14 that performs transcription on a surface of the transfer medium S is provided to face the drive roller 8 that is grounded across the intermediate transfer belt 7. The DC-voltage of the opposite polarity to the toner (in this embodiment, the positive polarity) is applied to the secondary transfer roller 14 by the not-illustrated DC power supply, and a toner image superimposed and carried on the intermediate transfer belt 7 is transferred on a surface of the transfer medium S via the secondary transfer roller 14.

The transfer medium S such as transfer paper is conveyed per sheet from the paper-feeding cassette 21 or the like by a paper-feeding roller 27, and via a register roller 13, further conveyed to be overlapped on the intermediate transfer belt 7 sandwiched between the secondary transfer roller 14 and the drive roller 8, and then the toner image is transferred from the intermediate transfer belt 7 in a secondary transfer part. The transfer medium S on which the toner image is transferred is sent to a fuser device 15, and fixation by thermal fusing is performed by a fuser roller 15*a* and a pressure roller 15*b*, and then the transfer medium S is ejected to a paper catchment part 18.

Figure 3:
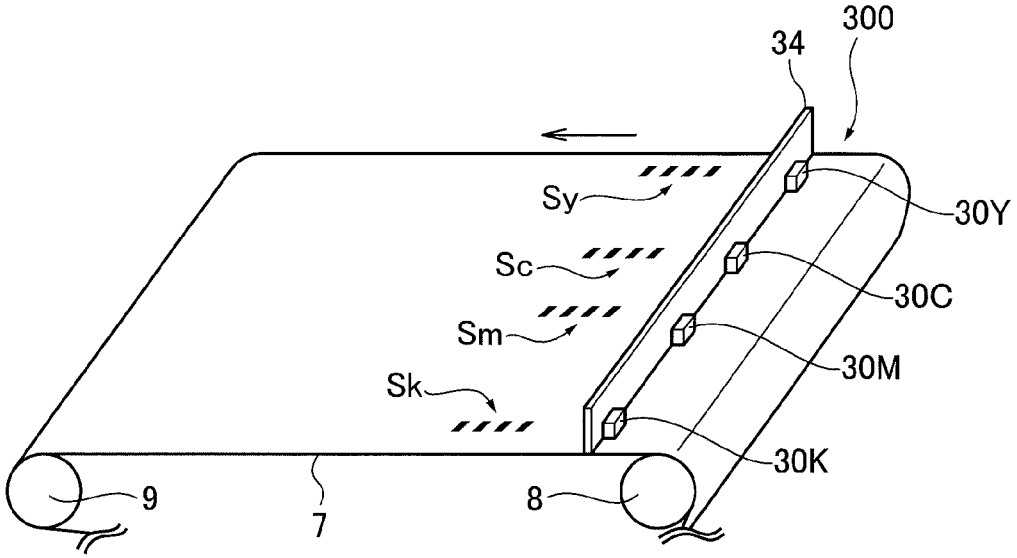
FIG. 3 is an enlarged schematic constitution diagram explaining a constitution of a vicinity of an intermediate transfer belt of the printer.

In a printer in the present embodiment, other than the above-described image-forming mode, when turning the power on, or after feeding a predetermined number of sheets of paper, image quality adjustment that adjusts image density of each color properly is performed. In image adjustment control, as illustrated in FIG. 3, by firstly switching sequentially a charging bias and developing bias at a suitable timing, on the intermediate transfer belt 7, a plurality of scale patterns Sy, Sc, Sm, Sk of each color as a toner image for image quality adjustment is formed. Those scale patterns Sy, Sc, Sm, Sk are detected by each of the sensor parts 30Y, 30C, 30M, 30K of the optical sensor unit 300 arranged outside the intermediate transfer belt 7 in the vicinity of the drive roller 8, an output voltage is converted to an adhesion amount, and as described later, control that changes a developing bias value and a toner density control target value is performed.

Figure 4:
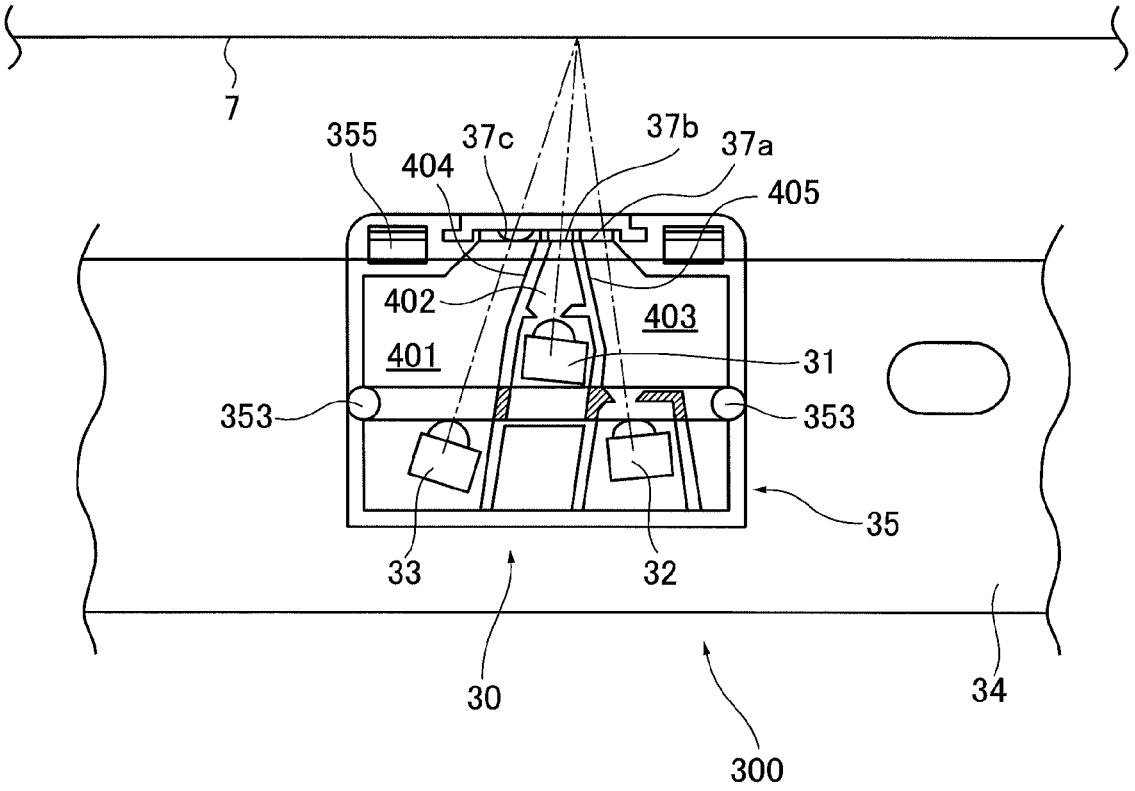
FIG. 4. is a schematic constitution diagram explaining a constitution of a sensor part of an optical sensor unit.

FIG. 4 is a schematic diagram of one of four sensor parts 30Y, 30C, 30M, 30K provided on a printed board 34 of the optical sensor unit 300. A constitution of each of the sensor parts 30Y, 30C, 30M, and 30K is the same, and therefore in the following explanation, color reference codes are omitted, and, for example, each of the sensor parts 30Y, 30C, 30M, and 30K will be explained as a sensor part 30. Each of FIGS. 5A and 5B is a cross-sectional diagram explaining the constitution of the sensor part 30.

As described in FIG. 4, the sensor part 30 in the present embodiment has a light-emitting element 31 as a light-emitting device, and a first light-receiving element 32 and a second light-emitting element 33 as light-receiving devices for receiving reflected light. Each element 31, 32, 33 is mounted on the printed board 34. Each element 31, 32, 33 is enclosed in an upper case 35. In the upper case 35, a path 402 for ensuring an emitted light path of light emitted from the light-emitting element 31 reaching the intermediate transfer belt 7 or a toner image on the intermediate transfer belt 7 (hereinafter, referred to as an object to be detected), and paths 402, 403 for ensuring incident light paths of light reflected by the object to be detected reaching the first light-receiving element 32 and the second light-receiving element 33 are formed. A space constructed by the light-emitting element 31 and the path 402, and a space constructed by the first light-receiving element 32 and the path 403 are separated by a light-blocking wall 405. Light from the light-emitting element 31 is suppressed to directly enter the first light-receiving element 32. Additionally, a space constructed by the light-emitting element 31 and the path 402, and a space constructed by the second light-receiving element 33 and the path 401 are separated by a light-blocking wall 404. Light from the light-emitting element 31 is suppressed to directly enter the second light-receiving element 33. A condensing lens 37*b* is arranged on the emitted light path in the upper case 35, and also on the incident light paths, condensing lenses 37*a*, 37*b* are arranged.

As illustrated in FIGS. 5A and 5B, the upper case 35 is fixed on the printed board 34 by fitting a lower case 36 via the printed board 34. Fitting of the upper case 35 and the lower case 36 are performed as follows. Positioning of the upper case 35 is performed to insert a positioning projection 353 of the upper case 35 to both ends of a through-hole 341 from a mount surface side of the printed board 34. And from an opposite side of the mount surface side of the printed board 34, projection parts 361, 362 of the lower case 36 are inserted to the upper case 35. Specifically, the projection part 361 of the lower case 36 is inserted to a concave part of the upper case 35 over an end of the printed board 34, and a nail part

361*a* provided on a tip of the projection part 361 fits a stopper provided in the concave part. And additionally, the projection part 362 of the lower part 361 is inserted to a hole of the upper case 35 through the through-hole 341 of the printed board 34, and a nail part 362*a* provided on a tip of the projection part 262 fits a stopper provided in the hole provided in the upper case 35. Here, in the lower case 36, a light-blocking member 363 that is inserted to the through-hole 341 and projects from the through-hole 341 is formed. The light-blocking member 363 blocks light that enters the printed board 34 at the through-hole 341, and blocks light emitted from the light-emitting element 31 so as not to be directly received by the light-receiving elements 32, 33. And on a plane of the lower case 36 that faces the printed board 34, a rib 364 is provided so that the printed board 34 does not rattle in the lower case 36.

As illustrated in FIG. 6, the optical sensor unit 300 includes a shutter member 130 that suppresses the adherence of dust or the like on the condensing lenses 37*a* to 37*c* of the sensor part 30. A shutter member 130 may be provided for each of the sensor parts 30Y, 30C, 30M, 30K, or the condensing lenses of each of the sensor parts 30Y, 30C, 30M, 30K may be covered by one shutter member 130. The shutter member 130 is at an open position illustrated by a dotted-line in the drawing when the sensor part 30 detects the scale patterns Sy, Sc, Sm, Sk, and at times other than the above, the shutter member 130 is at a closed position illustrated by a solid line in the drawing, faces an incident/exit plane which has an exit part where light of the optical sensor unit is emitted and an incident part where reflected light enters, where the condensing lenses 37*a* to 37*c* are provided, and covers the condensing lenses 37*a* to 37*c*. Thus, toner and dust are prevented from adhering on the condensing lenses 37*a* to 37*c*.

In the sensor part 30 as constructed above, light emitted from the light-emitting element 31 moving along a surface of the printed board 34 is refracted by the condensing lens 37*b*, and is focused on a surface of an object to be detected (intermediate transfer belt 37 or toner image). Specular reflection light reflected from the object to be detected passes through the condensing lens 37*a*, moves along the surface of the printed board 34, and enters the first light-receiving element 32. Diffuse reflection light reflected from the toner image passes through the condensing lens 37*c*, moves along the surface of the printed board 34, and enters the second light-receiving element 33. Instead of the condensing lenses 37*a* to 37*c*, a member such as a transparent sheet, a film for dust prevention, or the like may be used. Similarly, instead of the lens, a filter that selects a wavelength may be used.

In the optical sensor unit 300 as described above, other than reflected light from the object to be detected such as a reference toner image on the intermediate transfer belt 7, as illustrated by a dotted-line in FIG. 7, reflected light from the condensing lenses or the like may enter. An output signal of a light-receiving element by the light other than the reflected light from the object to be detected is called crosstalk (a crosstalk voltage in a case where the output signal is a voltage), which degrades detection accuracy of the object to be detected, and is preferably suppressed to as low a level as possible. A value of the crosstalk is measured by a shipping test of the optical sensor unit 300 or the like, and the value of the crosstalk is stored in a non-volatile memory device. And the value of the crosstalk stored in the non-volatile memory device is subtracted from an output value of the light-receiving element when the object to be detected such as the reference toner image or the like is detected, and thereby it is possible to remove most of the noise due to the crosstalk. However, there is a case where the value of the crosstalk changes due to temperature, humidity, a chronological change, or the like, and there is a case where detection accuracy of the sensor part 30 may be degraded.

Therefore, in the present embodiment, it is possible to detect a crosstalk voltage in a state where the optical sensor unit 300 is installed in the printer 100, and even in the case where the value of the crosstalk changes due to temperature, humidity, the chronological change, or the like, it is possible to inhibit the detection accuracy of the optical sensor unit 300 from degrading. In the following, a constitution that detects the crosstalk voltage will be specifically explained.

FIG. 8 is a diagram that illustrates a constitution that detects a crosstalk voltage of the present embodiment.

As illustrated in the drawing, in the present embodiment, a facing part 131 of the shutter member 130 that faces an incident/exit plane 38 of the sensor part 30 is inclined to the incident/exit plane 38 so that a facing surface that faces the incident/exit plane 38 of the facing part 131 is an inclined surface. The inclined surface is a flat and smooth surface (mirror surface), which reflects the light entering the inclined surface specularly.

In a case of detecting the crosstalk voltage, the shutter member 130 is placed at a closed position, and the inclined surface 131*a* faces toward the incident/exit plane 38 of the sensor part 30. Light emitted from the light-emitting element 31 to the inclined surface 131*a* of the shutter member 130 is reflected by the inclined surface 131*a*, as illustrated in FIG. 8, in directions other than a direction that enters the light-receiving elements 32, 33. Therefore, an output voltage of the first light-receiving element 32 and an output voltage of the second light-receiving voltage 33 obtained by emitted light at this time are output voltages by the light other than light reflected by the object to be detected, that is, so-called crosstalk voltages. Thus, it is possible to detect a crosstalk voltage of the first light-receiving element 32 and a crosstalk voltage of the second light-receiving element.

As illustrated in FIG. 9, in a case where the optical sensor unit 300 is arranged below the intermediate transfer belt 7, it is preferable that the facing part 131 be inclined such that a distance from the incident/exit plane 38 be longer on a downstream side in a moving direction where the shutter member 130 moves from the open position (position illustrated by a dotted-line in the drawing) to the closed position (position illustrated by a solid line in the drawing), compared to on an upstream side. Thus, in a case where the optical sensor unit 300 is arranged below the intermediate transfer belt 7, toner and dust T are accumulated on a surface 131*b* of the facing part 131 facing the intermediate transfer belt 7. Therefore, if the facing part is inclined such that the distance from the incident/exit plane 38 is shorter on the downstream side in the moving direction where the shutter member 130 is moved from the open position to the closed position, compared to on the upstream side, and when the shutter member 131 is moved from the closed position to the open position, there is a possibility that the toner and dust T accumulated on the surface 131*b* of the facing part 131 facing the intermediate transfer belt 7 slip from the surface 131*b*, and adhere to the condensing lens 37 of the sensor part 30. In order to inhibit such a situation, as illustrated in FIG. 9, the facing part 131 is inclined such that the distance from the incident/exit plane 38 is longer on the downstream side in the moving direction where the shutter member 130 moves from the open position to the closed position, compared to on the upstream side, and therefore it is possible to make the surface 131*b* of the facing part 131 facing the intermediate transfer belt 7 to be an inclined surface such that a distance to the intermediate transfer belt 7 is shorter on the downstream side in the moving direction where the shutter member 130 is moved from the open position to the closed position, compared to on the upstream side. Thus, it is possible to inhibit the toner and dust T accumulated on the surface facing the intermediate transfer belt 7 from falling on the condensing lens 37.

Additionally, as illustrated in FIG. 10, in a case where the optical sensor unit 300 is arranged above the intermediate transfer belt 7, contrary to FIG. 9, it is preferable that the facing part 131 be inclined such that the distance from the incident/exit plane 38 be shorter on a downstream side of the facing part 130 in the moving direction where the shutter member 130 moves from the open position to the closed position, compared to on the upstream side. As illustrated in FIG. 10, in a case where the optical sensor unit 300 is arranged above the intermediate transfer belt 7, toner and dust are not accumulated on the surface 131*b* of the facing part 131 facing the intermediate transfer belt 7. Therefore, as illustrated in FIG. 10, if the facing part 131 is inclined, toner and dust accumulated on the surface 131*b* of the facing part 131 facing the intermediate transfer belt 7 do not fall on the condensing lens 37, when the shutter member 130 is moved from the closed position to the open position. Therefore, in this case, as illustrated in FIG. 10, by making the upstream side of the facing part 130 to be shorter than the downstream side where the shutter member 130 moves from the open position to the closed position, it is possible to inhibit toner and dust T1 floating in the apparatus from entering from a gap between an end of the shutter member 130 and the incident/exit plane 38.

As illustrated in FIGS. 9 and 10, the facing part 131 of the shutter member 130 is inclined, and a surface 131*a* of the facing part 131 facing the incident/exit plane 38 is inclined, and thereby it is possible to incline the surface 131*a* of the facing part 131 facing the incident/exit plane 38 with a simple constitution.

Additionally, as illustrated in FIG. 11, by thickening an end side of the facing part 131 of the shutter member 130, the surface 131*a* of the facing part 131 facing the incident/exit plane 38 may be inclined such that the distance from the incident/exit plane 38 is shorter on the downstream side of the surface 131*a* of the facing part 131 facing the incident/exit plane 38 in the moving direction where the shutter member 130 moves from the open position to the closed position, compared to the upstream side, and the surface 131*b* of the facing part 131 facing the intermediate belt 7 may be inclined such that the distance from the incident/exit plane 38 is longer on the downstream side of the surface 131*b* of the facing part 131 facing the intermediate transfer belt 7 (surface on a side of the object to be detected) in the moving direction where the shutter member 130 moves from the open position to the closed position, compared to the upstream side. By constituting the shutter member 130 in this way, it is possible to inhibit toner and dust floating in the apparatus from entering from the gap between the end of the shutter member 130 and the incident/exit plane 38, and the toner and dust accumulated on the surface of the facing part 131*b* facing the intermediate transfer belt 7 from falling on the condensing lens 37.

Further, as illustrated in FIG. 12, a surface of the facing part 131 of the shutter member 130 facing the incident/exit plane 38 may have a plurality of inclined surfaces 133 that is inclined in the same direction. In order to prevent reflected light from the surface 131*a* of the facing part 131 facing the incident/exit plane 38 from entering the light-receiving elements 32, 33, it is necessary to increase an inclined angle of the surface 131*a* of the facing part 131 facing the incident/exit plane 38 to some degree. Therefore, in a case where the surface 131*a* facing the incident/exit plane 38 is entirely inclined, the facing part may become larger in the optical axis direction. On the other hand, as illustrated in FIG. 12, a surface of the facing part 131 of the shutter member 130 facing the incident/exit plane 38 has a plurality of inclined surfaces 133 that is inclined in the same direction so that the inclined angle of each inclined surface can be large, and a size of the facing part in the optical axis direction can be short. Thus, it is possible to narrow a gap between the incident/exit plane 38 and the intermediate transfer belt 7, and it is further possible to prevent toner and dust from entering from the gap between the facing part 131 of the shutter member 130 and the incident/exit plane 38.

Furthermore, as illustrated in FIG. 13, the light absorption member 132 such as a hair-transplanted sheet or the like may be adhered on a surface (inclined surface) 131*a* of the facing part 131 facing the incident/exit plane 38. It is possible to reduce the reflected light from the inclined surface 131*a* by adhering the light absorption member 132 to the inclined surface 131*a*. Therefore, it is further possible to inhibit the amount of light that enters the light-receiving elements 32, 33, and measure a crosstalk voltage value accurately. In addition, by use of the hair-transplanted sheet as the light absorption member 132, toner and dust entering a gap between the facing part 131 of the shutter member 130 and the incident/exit plane 38 adhere to the light absorption member 132, and it is possible to enhance a dust-proof function. In FIG. 13, the constitution where the light absorption member 132 is adhered on the inclined surface 131*a* is shown; however, a light absorption coating material may be applied on the inclined surface 131*a* is shown. By applying the coating material, it is possible to reduce the cost, compared to a case where the light absorption member 132 is adhered.

Next, detection of a crosstalk voltage will be explained.

In the present embodiment, the detection of the crosstalk voltage is performed as a pre-operation of image adjustment control (hereinafter, referred to as process control).

FIG. 14 is a block diagram illustrating a chief constitution of an electric circuit for image quality adjustment control of the printer. As illustrated in FIG. 14, a controller 200 of the printer has functions as an image quality adjustment controller that performs image quality control based on a detection result of the sensor part 30 as described later, and as a corrector that corrects an output value of a light-emitting element based on a crosstalk voltage. That is, the optical sensor unit 300 of the present embodiment includes the sensor part 30, the shutter member 130, and the controller 200.

The controller 200 has a CPU (Central Processing Unit) 201, a RAM (Random-Access Memory) 202, a ROM (Read-Only Memory) 203, and the like. The controller 200 is electrically connected to the image-forming units 1Y, 1C, 1M, 1K, the exposure device 20, the optical sensor unit 300, and the like. And in the non-volatile memory device 204 of the controller 200, crosstalk voltage values of the first light-receiving element 32 and crosstalk voltage values of the second light-receiving element 33 are stored. The crosstalk voltage values are stored in each of the sensor parts 30Y, 30C, 30M, 30K of the optical sensor unit 300.

FIG. 15 is a flow diagram of image density control.

Firstly, the controller 200 performs calibration of each of the sensor parts 30Y, 30C, 30M, 30K (step S1). The calibration of the sensor part 30 is performed as follows. Firstly, after moving the shutter member 130 from the closed position to the open position, light is emitted on the intermediate transfer belt 7 and the first light-receiving element 32 receives specular reflection light. And then an output voltage value of the first light-receiving element 32 is examined as to whether it is in a predetermined range or not. When the output voltage value of the first light-receiving element 32 is not in the predetermined range, the intensity of light emitting of the light-emitting element 31 is adjusted by adjusting a supply current If supplied to the light-emitting element 31 of the sensor part 30 such that the output voltage value of the first light-receiving element 32 is in the predetermined range. By performing such a calibration, it is possible to inhibit variations of output voltage values of the light-receiving elements 32, 33 due to a change of the intensity of light emitting such as an individual difference of light-emitting efficiency of the light-emitting element 31, a temperature change, a chronological change or the like, and accurately measure density of the toner image. On the other hand, in a case where the output voltage value of the first light-receiving element 32 is in the predetermined range, the calibration of the sensor part 30 ends. Thus, the controller 200 has a function as a light-emitting amount adjustment device that adjusts a light-emitting amount of the light-emitting element 31 to change a value of electric current supplied to the light-emitting element 31 referring to the output voltage from the first light-receiving element 32.

FIG. 16 is a graph illustrating a relationship between the crosstalk voltage and the supply current If supplied to the light-emitting element 31. If the supply current If supplied to the light-emitting element 31 increases, the intensity of light emitting of the light-emitting element 31 increases, and the crosstalk voltage also increases. Therefore, in the calibration of the sensor part 30, in a case where the supply current If is changed (YES of step S2), the detection of the output voltage of the first light-receiving element 32, and the output voltage of the second light-receiving element 33 is performed (step S3). The detection of the output voltage is performed as follows. The shutter member 130 is moved from the open position to the closed position, and light is emitted on the inclined surface 131*a* of the facing part 131 of the shutter member 130, and the output voltage values of the first light-receiving element 32 and the second light-receiving element 33 are measured at this time. In a case where a detected crosstalk voltage value is larger than a value that is normally considered, there is a problem in the sensor part 30 in the first place. Accordingly, in a case where the detected crosstalk voltage value is equal to or more than the predetermined value (YES of step S4), a massage informing a user that there is a problem in the sensor part 30 is displayed on a display 112, and a warning alarm is raised via a speaker 111 (step S6). And then, it is encouraged that the user change the optical sensor unit 300, and the operation ends without performing the process control.

On the other hand, in a case where the detected crosstalk voltage value is less than or equal to the predetermined value (NO of step S4), a crosstalk voltage value stored in the non-volatile memory device 204 is renewed to the detected crosstalk voltage value (step S5).

When the pre-operation such as the calibration of each of the sensor parts 30Y, 30C, 30M, 30K, the detection of the crosstalk voltage, and the like is finished, the controller 200 performs the process control (step S7).

FIG. 17 is a control flow diagram illustrating steps of the process control. Firstly, the controller 200 automatically forms each of the scale patterns Sy, Sc, Sm, Sk of each of the Y, C, M, K colors at a position facing each of the sensor parts 30Y, 30C, 30M, 30K on the intermediate transfer belt 7 (step S11). Specifically, the photoreceptors 2Y, 2C, 2M, 2K are rotated and charged uniformly. The charge potential at this time is different from a uniform drum charge potential in a print process, and a value is gradually increased. And a plurality of patch electrostatic latent images is formed on the photoreceptors 2Y, 2C, 2M, 2K, respectively, by scanning of the laser beam, in order to form the scale patterns Sy, Sc, Sm, Sk, which are developed by the developing devices 4Y, 4C, 4M, 4K. In a case of this development, the controller 200 gradually increases a value of a developing bias applied to the developing sleeves 41Y, 41C, 41M, 41K. By such a development, on the photoreceptors 2Y, 2C, 2M, 2K, the scale patterns Sy, Sc, Sm, Sk of Y, C, M, K are formed. Those are primarily transferred to line at predetermined intervals in a main scanning direction of the intermediate transfer belt 7.

Each of the scale patterns Sy, Sc, Sm, Sk formed on the intermediate transfer belt 7 passes through the position facing each of the sensor parts 30Y, 30C, 30M, 30K along with an endless movement of the intermediate transfer belt 7. At this time, each of the sensor parts 30Y, 30C, 30M, 30K receives an amount of light in accordance with a toner adhesion amount per unit area with respect to a toner patch of each of the scale patterns Sy, Sc, Sm, Sk (step S12). In a case of a K color toner, since emitted light is absorbed on a toner surface, a diffuse reflection light component is hardly included, and is negligible. Therefore, the sensor part 30K of the K color performs detection of the adhesion amount by use of the output voltage of the first light-receiving element 32 that receives the specular reflection light. On the other hand, in a case of each color toner of the Y, C, and M colors, since emitted light is diffusely-reflected by a toner surface, a large amount of diffuse reflection light other than specular reflection light is included in the first light-receiving element 32 of each of the sensor parts 30Y, 30C, and 30M. Therefore, the sensor parts 30Y, 30C, and 30M perform the detection of the adhesion amount by use of the output voltage of the second light-receiving element 33 that receives the diffuse reflection light. However, since the crosstalk voltage is included in the output voltage of each of the sensor parts 30Y, 30C, 30M, 30K obtained by detecting the toner patch of each of the scale patterns, the detection value is not considered to be highly accurate. Accordingly, the controller 200 performs an output value correction operation that removes a crosstalk voltage component on the output voltage of each of the sensor parts 30Y, 30C, 30M, 30K obtained by detecting the toner patch of each of the scale patterns Sy, Sc, Sm, Sk (step S13).

The output value correction operation is performed as follows. Firstly, a crosstalk voltage value stored in the non-volatile memory device 204 of the controller 200 is read out. In a case of the sensor part 30K that detects a toner patch of the scale pattern Sk of the K color, a crosstalk voltage value of the first light-receiving element 32 stored in the non-volatile memory device 204 is read out. And then, the read-out crosstalk voltage value of the first light-receiving element 32 is subtracted from an output voltage value of the first light-receiving element 32 when each toner patch is detected. Thus, the output voltage of the first light-receiving element 32 where the crosstalk voltage is removed can be obtained. On the other hand, in a case of each of the sensor parts 30Y, 30C, and 30M that detects the toner patch of each of the scale patterns Sy, Sc, and Sm of the Y, C, and M colors, crosstalk voltage values of the second light-receiving element 33 stored in the non-volatile memory device 204 are read out. And then, the read-out crosstalk voltage values of the second light-receiving element 33 are subtracted from output voltage values of the second light-receiving element 33 when each toner patch is detected. Thus, the output voltage where the crosstalk voltage is removed can be obtained.

Next, the adhesion amount of each of the toner patches is calculated based on the output voltage of each of the sensor parts 30Y, 30C, 30M, 30K where the crosstalk voltage is removed by the output value correction operation (step S14).

In the controller 200, an adhesion amount conversion algorithm that shows a relationship between a value of the output voltage from each of the sensor parts 30Y, 30C, 30M, 30K and its corresponding toner amount is stored. A specular reflection light output amount of the sensor parts 30Y, 30C, 30M, 30K (output voltage of the first light-receiving element 32 that receives specular reflection light) and the toner adhesion amount have a relationship (specular reflection light algorithm) as shown in FIG. 18, and the specular reflection amount of light reduces when the toner adhesion amount increases because specular reflection light from a skin part of the intermediate transfer belt 7 reduces. In addition, a diffuse reflection light output amount of the sensor parts 30Y, 30C, 30M, 30K (output voltage of the second light-receiving element 33 that receives diffuse reflection light) and the toner adhesion amount have a relationship (diffuse reflection light algorithm) as shown in FIG. 19, and the diffuse reflection amount of light increases when the toner adhesion amount increases because diffuse reflection light from color toners increases. And then, an adhesion amount in each toner patch of the scale pattern Sk of the K color is calculated from the output voltage where the crosstalk voltage of the first light-receiving element 32 is removed when the toner patch of the K color is detected, and the above-described specular reflection light algorithm. Additionally, an adhesion amount in each toner patch of the scale patterns Sy, Sc and Sm of the Y, C, and M colors is calculated from the output voltage where the crosstalk voltage of the second light-receiving element 33 is removed when the toner patches of the Y, C, and M colors are detected, and the above-described diffuse reflection light algorithm. Thus, in the present embodiment, since a toner adhesion amount is calculated from the output voltage where crosstalk voltage is removed, it is possible to calculate a highly-accurate adhesion amount.

After calculating the adhesion amount of each toner patch in the scale patterns Sy, Sc, Sm, Sk of each color, an image-forming condition is adjusted based on each toner patch in the scale patterns Sy, Sc, Sm, Sk of each color (step S15). In each of the Y, C, M, K colors, a plurality of toner patches in each of the scale patterns Sy, Sc, Sm, Sk is developed by a combination of each different drum charge potential and developing bias, and a toner adhesion amount per unit area (image density) gradually increases. Since the toner adhesion amount has a correlative relationship with a developing potential, that is, a difference between the drum charge potential and the developing bias, the relationship between both is an approximately straight line graph on a two-dimensional coordinate. The controller 200 calculates a function ($y=ax+b$) expressing the straight line graph by regression analysis, based on a detected result of the toner adhesion amount in each toner patch, and the developing potential when forming each toner patch. And the controller 200 calculates a suitable developing bias value by substituting a target value of the image density in the function, and stores it as a correction developing bias value for each of the Y, C, M, K.

In the controller 200, a data table of an image-forming condition where dozens of developing bias values and individually-corresponding suitable drum charge potentials are related beforehand is stored. The controller 200, regarding the image-forming units 1Y, 1C, 1M, 1K, chooses a developing bias value that is closest to the above-described correction developing bias value from the data table of image-forming condition, respectively, and specifies a drum charge potential related thereto. The specified drum charge potential is stored as a correction drum charge potential for the Y, C, M, K. And then, after finishing storing all of the correction developing bias values and correction drum charge potential, data of the developing bias values for the Y, C, M, K is corrected to values equivalent to corresponding correction developing bias values, respectively, and stored again. Further, data of the drum charge potential for the Y, C, M, K is also corrected to values equivalent to the corresponding correction drum charge potential, respectively, and stored again. By such correction, an image-forming condition for forming an image is corrected to a condition capable of respectively forming an image of desired image density.

In the above, the crosstalk voltage is detected when the supply current If is changed; however, the crosstalk voltage may be detected every time image quality adjustment control is performed. Additionally, in a case where the sensor part 30 of the sensor unit 300 is changed, the crosstalk voltage is detected as an initial operation, and a detected crosstalk voltage value is stored in the non-volatile memory device.

In the present embodiment, the optical sensor unit 300 has a plurality of sensor parts 30Y, 30C, 30M, 30K; however, as illustrated in FIG. 20, the optical sensor unit 300 may have one sensor part. In this case, since there is only the one sensor part, there is an advantage in that the cost of the apparatus can be reduced. However, since the one sensor part detects the scale patterns of the Y, C, M, K, the operation time of the process control is longer, and there is a disadvantage in that the downtime of the apparatus is longer.

In the present embodiment, the optical sensor unit 300 is provided to face the intermediate transfer belt 7; however, the optical sensor unit 300 may be provided to face a photoreceptor surface. In this case, an optical sensor unit 300 having one sensor part 30 is used. And a sensor part 30 may be provided to face transfer paper.

In addition, the above-described sensor part 30 receives reflected light as specular reflection light and diffuse reflection light; however, the embodiment of the present invention can also be applied to an optical sensor unit 300 having a sensor part that receives one of the specular reflection light and diffuse reflection light, and an optical sensor unit 300 having a sensor part that has equal to or more than two light-receiving elements. The embodiment of the present invention can also be applied to an optical sensor unit 300 having a sensor part that obtains various light characteristics by reflected light such as a sensor part using a spectral characteristic of so-called P wire wave/S wave, or the like.

The above-described explanation is an example, and according to an embodiment of the present invention, the following effects are obtained.

(1)

It is possible to accurately detect an object to be detected, because a crosstalk voltage value is accurately measured, and an output value of a light-receiving element when receiving light reflected from the object to be detected is corrected by the measured value.

(2)

It is possible to inhibit toner and dust from entering from a gap between an end of a shutter member and an incident/exit plane, and inhibit the toner and dust from adhering on the incident/exit plane.

(3)

It is possible to inhibit toner and dust accumulated on a surface on an object to be detected side of the shutter member from slipping from the end of the shutter member onto the incident/exit plane along with movement of the shutter member. And therefore, it is possible to inhibit the toner and dust from adhering on the incident/exit plane. In particular, in a case where the object to be detected is above a sensor part of an optical sensor unit, it is effective to employ an optical sensor unit having a constitution where a surface of the shutter member that is opposite to an inclined surface of the shutter member, and is a surface on the object to be detected side facing the object to be detected is an inclined surface such that a distance from the object to be detected is shorter on a downstream side in a moving direction where the shutter member is moved from an open position to a closed position, compared to on an upstream side in the moving direction.

(4)

Since a plurality of inclined surfaces is provided on a facing surface, compared to a case where an entire facing surface is the inclined surface, it is possible to increase an inclined angle of each of the inclined surfaces, and shorten a distance between the facing surface and the incident/exit plane entirely. And therefore, it is possible to inhibit the toner and dust from entering from a gap between the facing surface and the incident/exit plane.

(5)

By providing a light absorption member on the inclined surface, it is possible to reduce the amount of light reflected from the inclined surface, and further inhibit the reflected light from the inclined surface from entering a light-receiving device.

(6)

As the light absorption member, by use of a hair-transplanted sheet, it is possible to adhere the toner and dust entering the gap between the shutter member and the incident/exit plane on the hair-transplanted sheet, and inhibit the incident/exit plane from being contaminated.

(7)

By applying a light absorption coating material on the inclined surface, it is possible to reduce the amount of light reflected from the inclined surface, and further inhibit the reflected light from the inclined surface from entering the light-receiving device.

(8)

It is possible to detect a toner adhesion amount accurately, and perform highly-accurate image quality adjustment control.

According to an embodiment of the present invention, a surface of the shutter member facing the incident/exit plane is an inclined surface, and thereby the reflected light from the shutter member does not enter the light-receiving device. Accordingly, it is possible to reduce the number of components and the cost of the apparatus.

Additionally, it is possible to suitably remove noise due to crosstalk, and accurately detect the object to be detected.

Although the present invention has been described in terms of exemplary embodiments, it is not limited thereto. It should be appreciated that variations may be made in the embodiments described by persons skilled in the art without departing from the scope of the present invention as defined by the following claims.

What is claimed is:

1. An optical sensor unit comprising:

a light-emitting device;

a light-receiving device that receives light which is emitted from the light-emitting device and reflected from an object to be detected, and outputs an output value in accordance with the light;

a shutter member that openably and closably covers an incident/exit plane having an exit part where light of the light-emitting device is emitted to the object to be detected and an incident part where light reflected from the object to be detected enters, and has a facing surface facing the incident/exit plane that is an inclined surface which is inclined to the incident/exit plane when the shutter member covers the incident/exit plane; and a corrector that corrects an output value of the light-receiving device when receiving light reflected from the object to be detected, based on an output value of the light-receiving device obtained by emitting light to the inclined surface of the shutter member.

2. The optical sensor unit according to claim 1, wherein the facing surface is inclined such that a distance from the incident/exit plane is shorter on a downstream side in a moving direction when the shutter member moves from an open position to a closed position, compared to on an upstream side in the moving direction.

3. The optical sensor unit according to claim 1, wherein a surface that is opposite to the facing surface, and a surface on a side of the object to be detected facing the object to be detected is inclined such that a distance from the object to be detected is shorter on a downstream side in a moving direction when the shutter member moves from an open position to a closed position, compared to on an upperstream side in the moving direction.

4. The optical sensor unit according to claim 1, wherein the facing surface has a plurality of inclined surfaces.

5. The optical sensor unit according to claim 1, wherein a light absorption member is provided on the inclined surface.

6. The optical sensor unit according to claim 5, wherein as the light absorption member, a hair-transplanted sheet is used.

7. The optical sensor unit according to claim 1, wherein a light absorption coating material is applied on the inclined surface.

8. An image-forming apparatus comprising:

an image carrier that carries a toner image on a surface;

an optical sensor unit that detects reflected light from the toner image; and an image quality adjustment controller that forms a toner image for image quality adjustment on the surface of the image carrier, and performs image quality adjustment control, based on an output value of the optical sensor unit when receiving reflected light from the toner image for image quality adjustment, wherein as the image sensor unit, the image sensor unit according to claim 1 is used.

* * * * *